United States Patent [19]

Ben-dov

[11] 3,940,772

[45] Feb. 24, 1976

[54] CIRCULARLY POLARIZED, BROADSIDE FIRING TETRAHELICAL ANTENNA

[75] Inventor: Oded Ben-dov, Medford, N.J.

[73] Assignee: RCA Corporation, New York, N.Y.

[22] Filed: Nov. 8, 1974

[21] Appl. No.: 522,132

[52] U.S. Cl. ..... 343/853; 343/895

[51] Int. Cl.[2] ..... H01Q 1/36

[58] Field of Search ..... 343/895, 896, 853

[56] References Cited

UNITED STATES PATENTS

| | | | |
|---|---|---|---|
| 3,449,657 | 6/1969 | Fredriksson et al. | 343/895 |
| 3,503,075 | 3/1970 | Gerst | 343/895 |
| 3,599,220 | 8/1971 | Dempsey | 343/895 |

*Primary Examiner*—Eli Lieberman

*Attorney, Agent, or Firm*—Edward J. Norton; Robert L. Troike

[57] ABSTRACT

An antenna for radiating circularly polarized signals omnidirectionally about and broadside a support mast is provided by four conductors helically wound about the mast. The conductors are spaced from the mast and are equally distributed about the periphery of the mast with signals coupled to the conductors such that the phase of the signal coupled to one conductor is 180° out of phase with the phase of the signal coupled to adjacent conductors and is in phase with the phase of the signal coupled to the alternate conductor. The pitch of the helically wound conductors is selected relative to the radius of the conductors to achieve substantially circularly polarized radiation substantially perpendicular or broadside to the lengthwise axis of the mast.

7 Claims, 8 Drawing Figures

CIRCULARLY POLARIZED, BROADSIDE FIRING TETRAHELICAL ANTENNA

BACKGROUND OF THE INVENTION

This invention relates to circularly polarized antennas and more particularly to circularly polarized antennas for use in FM radio or in television broadcasting where the antennas are mounted on the top of a support tower and about a support mast which may be of conductive material.

Although horizontally polarized television broadcasting has been almost exclusively used in the United States, it appears from some recent test results, that circularly polarized broadcasting might well greatly improve television reception both in large metropolitan areas and in fringe areas.

This invention provides an antenna for broadcasting circularly polarized signals and which, when mounted on a support mast, radiates these signals in an omnidirectional pattern about the mast such that when this mast is erected in the center of a city, for example, substantially equal coverage is provided about the city. The problem of equal coverage about the mast becomes increasingly difficult with conventional antenna systems as the diameter of the mast becomes larger with attendant cloverleaf radiation patterns. These tower diameters tend to become fairly large if the tower supports many antenna systems for a plurality of broadcasters. The problem becomes increasingly difficult when this omnidirectional pattern is in the circularly polarized mode.

BRIEF DESCRIPTION OF INVENTION

Briefly, a low cost antenna for radiating circularly polarized signals over a given range of frequencies omnidirectionally about and broadside a support mast is provided by four conductors helically wound about and spaced from the mast a given radial distance from the center of the mast with each conductor spaced about 90° of arc about the mast from the adjacent conductors. The conductors are fed with equal power signals at a frequency within the given range of frequencies so that in a plane perpendicular to the axis of the mast the phase of the signals at one conductor is 180° out of phase with the phase of the signals at the two adjacent conductors and in phase with signals at the alternate conductor. The pitch angle of the conductors for the given radial distance is selected to radiate circularly polarized signals substantially broadside the support mast.

DETAILED DESCRIPTION OF THE INVENTION

A more detailed description of a preferred embodiment of the present invention follows in conjunction with the following drawings wherein.

Figure 1:
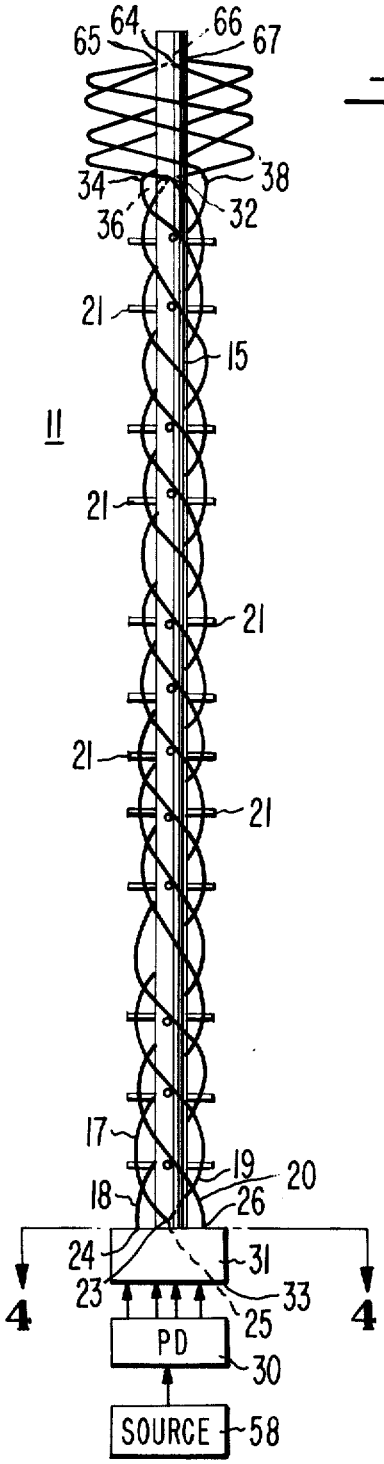
FIG. 1 is an elevation view of an antenna system according to a preferred embodiment of the present invention.

Referring to FIG. 1, there is illustrated a circularly polarized antenna system 11 mounted in the example on a vertically extending circular metal conducting mast 15. The mast 15 in this example is a hollow core metal mast. The antenna system includes four conductors 17, 18, 19 and 20 helically wound about the mast 15. The conductors are spaced from the mast 15 by spacers 21, which are made of insulator material.

Figure 2:
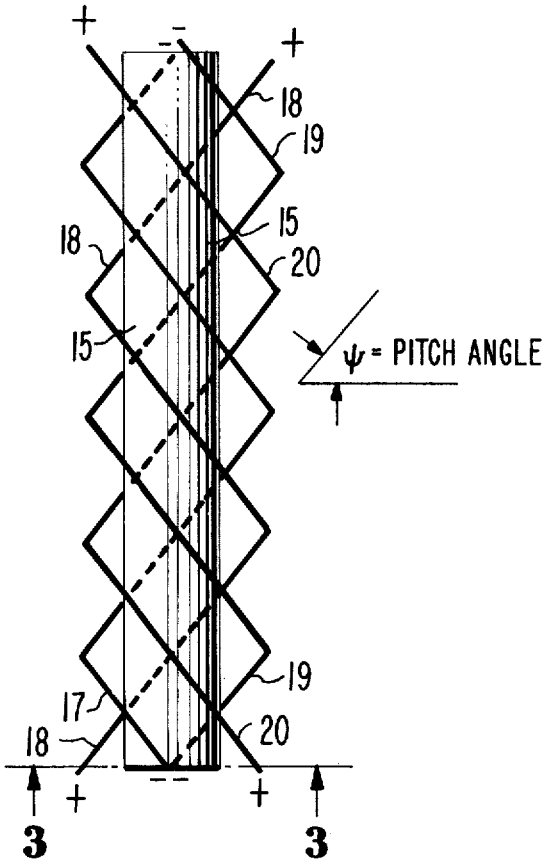
FIG. 2 is a sketch illustrating the helical conductors mounted about a support pole.
Figure 3:
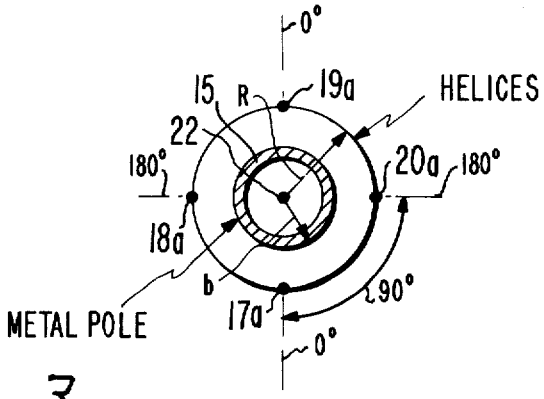
FIG. 3 is a sketch taken along lines 3—3′ in FIG. 2 illustrating the relative phases of the signals on the helical conductors and the radius of the helices.

As illustrated in the sketch of FIGS. 2 and 3, the four conductors 17, 18, 19 and 20 spiral about the mast, with each conductor always spaced 90° of arc from the adjacent conductors as the conductors spiral about the mast 15. The four conductors 17, 18, 19 and 20 spiral about the mast 15 a given radius R, illustrated in FIG. 3, from the center 22 of the mast. The conductors 17, 18, 19 and 20 are fed at the bottom end via feed 31 in FIG. 1, such that the adjacent conductors about the periphery of the mast are fed 180° out of phase and the alternate conductors are fed in phase. In other words, the phase of the signals about the mast 15 in a plane perpendicular to the lengthwise axis of the mast is (as illustrated in FIG. 3) 0°, 180°, 0°, 180° in either a clockwise or counterclockwise direction about the mast. This may be represented as −, +, −, and + about the mast 15. The dots 17*a*, 18*a*, 19*a*, and 20*a* in FIG. 3 represent the conductors 17, 18, 19, and 20 in a plane perpendicular to the lengthwise axis of the mast. These conductors may be connected to the mast at their free or top ends.

Figure 4:
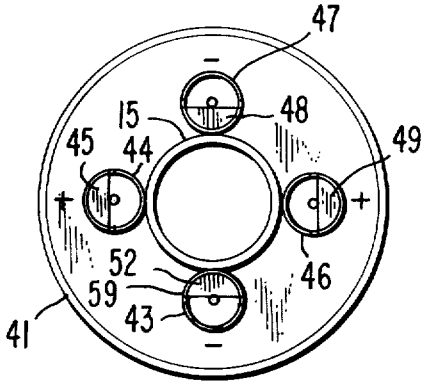
FIG. 4 is a sketch of the feed system taken along lines 4—4′ in FIG. 1.
Figure 5:
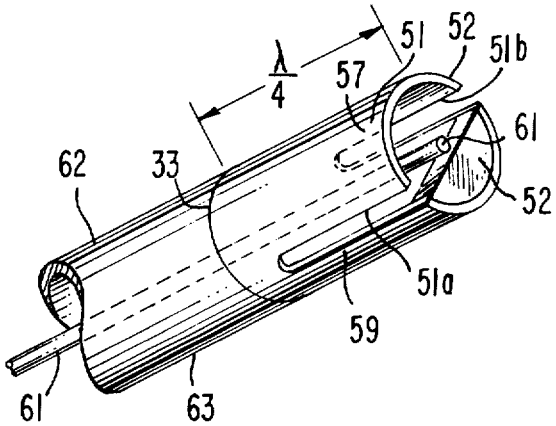
FIG. 5 is a perspective view of one of the baluns in FIG. 4.

To achieve this relative phase relationship the feed 31 may be like the system illustrated in FIGS. 4 and 5. A cylindrical shield 41 encloses the feed system 31. Inside the shield 41 are four baluns 43, 45, 47, and 49 spaced 90° arc from each other about the mast 15 extending through the center of the shield 41. The balun 43 is made of a section 51 of conductive tubing that extends at end 33 through the shield 41. The section 51 has two slits 51*a* and 51*b* one quarter wavelength long at the operating frequency of the antenna from the end 52 to form an upper half 57 and a lower half 59 near the end 52. The lower half 59 is filled at the end 52 with conductive material. A coaxial transmission line 63 is coupled at end 33 of the balun 43 with the outer conductor 62 of this coaxial transmission line 63 connected to the end 33 of the balun 43 and the shield 41. The center conductor 61 of the transmission line extends in insulative manner through the center of the balun 43 and makes contact with lower half 59 at end 52. The baluns 45, 47, and 49 are similar to the balun 43. The half 59 of balun 43 (represented by shading in FIG. 4 of the balun 43) connected to the center conductor 61 of the coaxial feed line 63 is connected to the mast 15. Similarly the half 48 of the balun 47 connected to the center conductor of its feed line is connected to mast 15. The halves 44 and 46 of the respective baluns 45 and 49 that are not directly connected to the center conductor of their feed lines are connected to the mast 15. The baluns 43, 45, 47, and 49 are connected to the wires 17, 18, 19, and 20, respectively, at the outboard halves of 43, 45, 47, and 49 not directly connected to the mast 15. The input power to the four coaxial lines feeding the baluns should be equal. This may be provided by a four way power divider 30 coupled between the signal source 58 and the four baluns 43, 45, 47, and 49 in feed 31.

Figure 6:
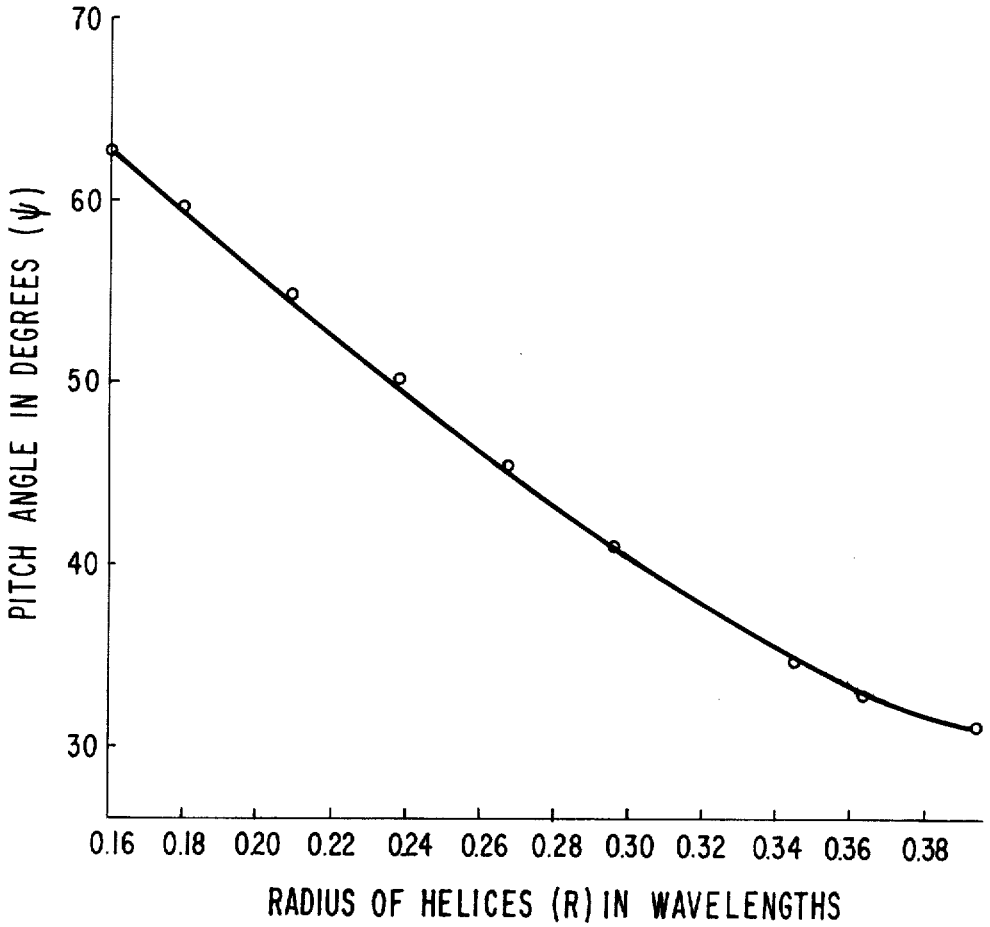
FIG. 6 is a plot of pitch angle in degrees versus the radius of the helices in wavelengths.

In the arrangement illustrated in FIG. 1, the conductors 17, 18, 19, and 20 are wound four turns at a pitch angle $\psi_1$ between feed points 23, 24, 25, and 26 on conductors 17, 18, 19, and 20 and points 32, 34, 36, and 38 on the conductors 17, 18, 19, and 20. The conductors 17, 18, 19, and 20 extend one turn beyond points 32, 34, 36, and 38 to the free ends 64, 65, 66, and 67, respectively, at a second pitch angle $\psi_2$. This pitch angle $\psi$ as illustrated in FIG. 2, is the angle of the slope of the coil (the vertical projection) relative to the axis perpendicular to the lengthwise axis of the mast 15. This pitch angle $\psi$ to achieve circular polarization and substantially broadside radiation (in a direction perpendicular to the lengthwise axis of the tower) is achieved by satisfying the following condition of $$\tan\psi = \frac{J_1\,(2\pi R/\lambda_0)}{2J_2(2\pi R/\lambda_0)}$$

where $\psi$ is the pitch angle, $R$ is the helix radius as illustrated in FIG. 3, $\lambda_0$ is the free space wavelength of a signal at a frequency within the operating frequencies of the antenna and $J_1$ and $J_2$ are the Bessel functions of the order of 1 and 2 respectively. The term $2\pi R/\lambda_0$ is the circumference in wavelengths of the coil. FIG. 6 is a plot of the solution of this equation for degrees in pitch angle ($\psi$) versus the radius $R$ of the helices.

It has been found that to achieve nearly perfect broadside radiation (radiation perpendicular to the lengthwise axis of the mast 15) the following relationship should be true $$\gamma/k = \frac{2\cos\psi}{kR}$$

where $\gamma$ equals the propagation constant along the helical conductors, $k$ is $2\pi/\lambda_0$, where $\lambda_0$ is a free space wavelength at a frequency within the operating frequencies of the antenna, $R$ is the helix radius and $\psi$ is the pitch angle as illustrated in FIG. 2.

The ratio of $\gamma/k$ should be less than one to achieve nearly perfect circular polarization and broadside radiation. This, however, may be difficult to achieve at a low cost. Reasonably good circular polarization with good broadside radiation can be achieved by ratios of $\gamma/k$ equal to 1. In the example discussed above operating at 958 MHz with a radius of the helices of 2.165 inches, a pitch angle $\psi_1$ of 60° was the solution to the first mentioned equation. However, due to difficulties in providing a ratio of $\gamma/k$ less than 1, a slight tilt angle was observed. By making a slight correction such that the second mentioned equation was satisfied with $\gamma/k =$ 1 and at 1020 MHz, the pitch angle was corrected to 54°. The tilt angle was minimized at the sacrifice of slight increase in the axial ratio (poorer circular polarization). The axial ratio was only slightly increased to 1.5 db. The solution also resulted in an approximation for determining the pitch angle on a more general basis for this particular example which is that the pitch angle and the radius is to be made so that each of the conductors make one complete turn about the mast over a length along the conductors about equal to two wavelengths at an operating frequency of the antenna.

It has been found that an improved omnidirectional pattern can be achieved by an extra two wavelengths long turn of the conductors at the free end with a smaller pitch angle $\psi_2$, and with the helices at a greater radius R as illustrated near the top of mast 15 in FIG. 1. The conductors 17, 18, 19 and 20 extend the other turn at this second pitch angle $\psi_2$ from points 32, 34, 36 and 38 in FIG. 1. This second pitch angle $\psi_2$ basically fits the first mentioned formula with larger valued radius $R$ of the helices. For operation at 1020 MHz, this radius $R$ of the helices was about 3⅝ inches [9.2 centimeters (cm)] and the pitch angle $\psi_2$ was 10°.

For the example discussed above and operated at 1020 MHz, the antenna had the other following dimensions.

Diameter of mast 15, 2¼ inches (5.72 cm)

Length of mast from point 33, where the baluns connect to coaxial feed lines, to ends 64, 65, 66 and 67 of conductors 17, 18, 19 and 20 — 80 inches (203 cm)

Length of balun section 31 along mast 15, 3 inches (7.6 cm)

Radius R of the helices of the conductors 17, 18, 19, 20 from points 23, 24, 25 and 26 to points 32, 34, 36 and 38, 2.165 inches (5.5 cm)

Pitch angle (as stated previously) $\psi_1 = 54°$

Radius R of the helices of the conductors 17, 18, 19 and 20 from points 32, 34, 36 and 38 to points 64, 65, 66 and 67, 3.625 inches (9.2 cm)

Pitch angle $\psi_2$, 10°

Diameter of conductor wire of conductors 17, 18, 19 and 20, 0.085 inch (0.216 cm).

The helices of conductors 17, 18, 19 and 20 extend at the pitch angle of 10° over a length along the mast 15 of about 5 inches (12.7 cm). Slight improvement was provided by extending the conductors an extra 3 inches (7.6 cm) beyond one complete turn beyond points 32, 34, 36 and 38 at the pitch angle of 10°.

Figure 7:
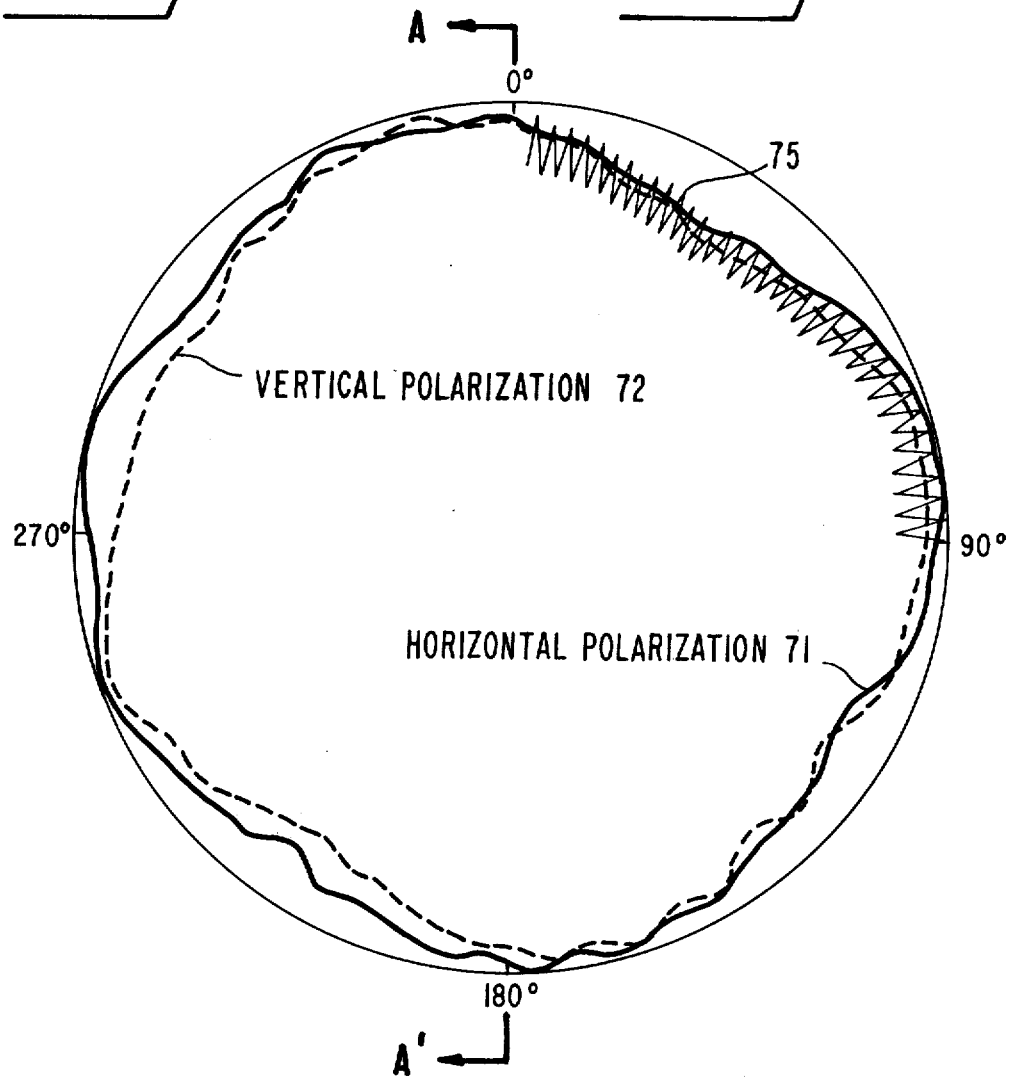
FIG. 7 illustrates the horizontal patterns associated with the antenna system of FIG. 1.
Figure 8:
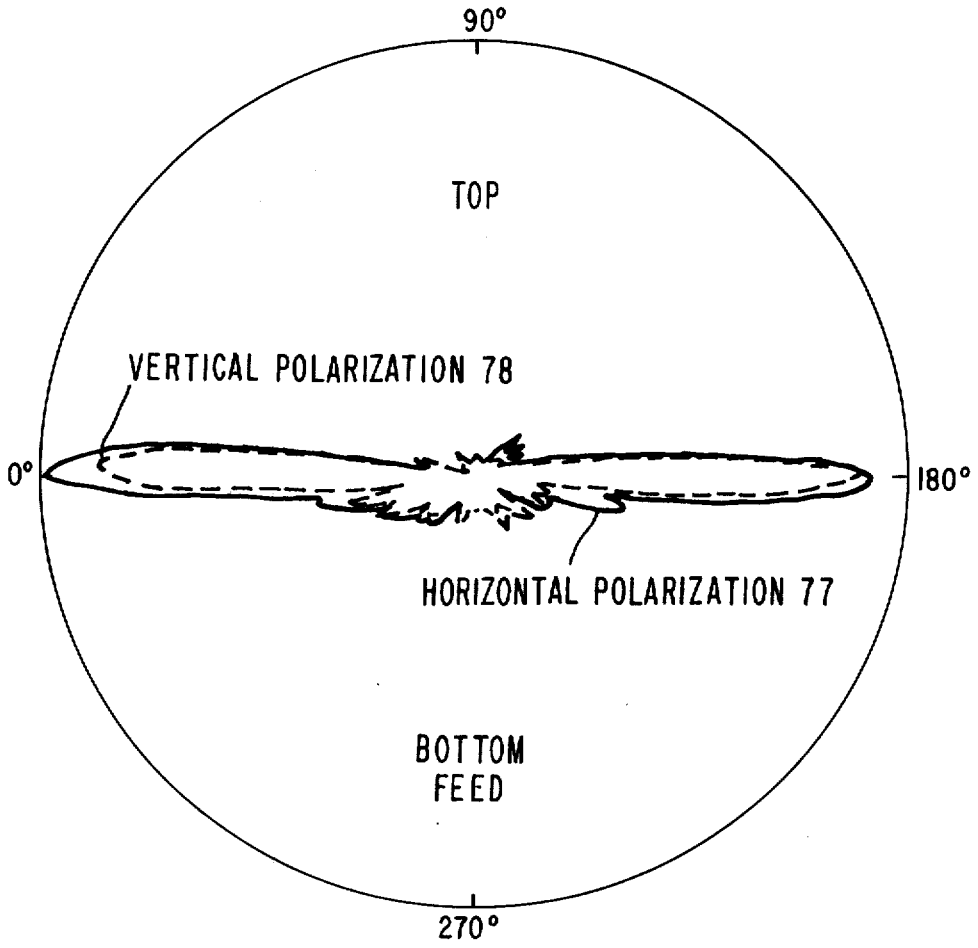
FIG. 8 illustrates the vertical patterns associated with the antenna system of FIG. 1 as viewed in the 0°–180° primary axis of FIG. 7 or in the direction of arrows A—A′ of FIG. 7.

FIG. 7 illustrates the horizontal pattern for an antenna system as described above. The horizontal polarization is represented by solid line 71 and the vertical polarization pattern is defined by the dashed lines 72. As can be seen viewing FIG. 7, they approximate each other. The serrated pattern 75 over one quadrant from 0° to 90° illustrates the axial ratio of this particular antenna when measured by a test set up as described by Dr. Ben-Dov in IEEE Transactions on Broadcasting, March 1972, entitled "Measurement of Circularly Polarized Broadcast Antennas." The minimum to maximum ratio of the serrated pattern at any azimuth angle is the axial ratio in that direction. This axial ratio is on the order of 1.5 db or less. It can be seen that a satisfactory omnidirectional pattern with low axial ratios is provided by this structure. It is also desirable that the energy be transmitted broadside of the mast 15. FIG. 8 illustrates the vertical pattern produced in the 0°–180° axis of FIG. 7 or in the direction of arrows A–A′ in FIG. 7. The pattern for the horizontally polarized radiation in the vertical pattern is essentially like that shown by dashed lines 77 in FIG. 8 and the pattern for the vertically polarized radiation is essentially like that shown by line 78.

While the above example was for 1020 MHz, a scaled version can be made for any of the television or FM carrier frequencies. For example, by making an antenna on the order of 5 to 1, or five times larger, the above antenna system would be usable at about television channel 12. Various other ratios may be used to operate with scaled versions at any of the television or FM radio frequencies.

What is claimed is:

1. An antenna for radiating circularly polarized signals over a given range of frequencies omnidirectionally about and broadside a support mast comprising:

four conductors helically wound about and spaced from the support mast a given radial distance from the center of the support mast with each conductor of said four conductors spaced about 90° of arc about the support mast from the adjacent two of said four conductors.

means for coupling equal power signals at the same frequency within said given range of frequencies to said four conductors so that in a plane perpendicular to the axis of the support mast the phase of the signals at one of said four conductors is 180° out of phase with the phase of the signals at the two of said four conductors adjacent thereto and is in phase with the phase of the signals at the one of said four conductors alternate therefrom, said four conductors at a pitch angle and at a given radial distance such that each of said four conductors makes a complete turn about said support mast in a length along said four conductors about equal to two wavelengths at a frequency within said given range of frequencies whereby circularly polarized signals are radiated substantially broadside said support mast.

2. The combination in claim 1 wherein said four conductors are fed by said coupling means at one end of the conductors.

3. The combination in claim 2 wherein said four conductors are helically wound at a first spaced radial distance from the mast near the feed point at one end and are wound at a second spaced radial distance greater than the first radial distance near the opposite free end of said conductors.

4. The combination in claim 3 wherein said four conductors extend for four turns about the mast at said first radial distance and extend for about one turn about the mast at said second radial distance.

5. The combination in claim 4 wherein said pitch angle of said conductors at said first and second radial distance approximates the following relationship of $$\tan\psi = \frac{J_1(2\pi R/\lambda_0)}{2J_2(2\pi R/\lambda_0)}\,;\ \gamma/k = \frac{2\cos\psi}{kR}$$

where $\psi$ is the pitch angle, $R$ is the radius of the helix formed by the conductor, $\lambda_0$ is a free space wavelength at a frequency within said given range of frequencies, $J_1$ is a Bessel function of the order of one and $J_2$ is a Bessel function of the order of two, $\gamma$ is the propagation constant along the helical conductor, and $k$ is $2\pi/\lambda_0$.

6. The combination in claim 4 wherein said pitch angle of said conductors at said first and second radial distances is such that each conductor makes a complete turn about said mast over a length along said conductor about equal to two wavelengths at a frequency within said given range of frequencies.

7. An antenna for radiating circularly polarized signals over a given range of frequencies omnidirectionally about and broadside a support mast comprising:

four conductors helically wound about and spaced from the support mast a given radial distance from the center of the support mast with each conductor of said four conductors spaced about 90° of arc about the support mast from the adjacent two of said four conductors, means for coupling equal power signals at the same frequency within said given range of frequencies to said four conductors so that in a plane perpendicular to the axis of the support mast the phase of the signals at one of said four conductors is 180° out of phase with the phase of the signals at the two of said conductors adjacent thereto and is in phase with the phase of the signals at the one of said four conductors alternate therefrom, said four conductors extending at a pitch angle relative to said given radial distance to radiate circularly polarized signals substantially broadside said support mast, said pitch angle $\psi$ for said given radial distance approximating the following relationships $$\tan\psi = \frac{J_1(2\pi R/\lambda_0)}{2J_2(2\pi R/\lambda_0)}\,;\ \gamma/k = \frac{2\cos\psi}{kR},$$

where $\psi$ is the pitch angle, $R$ is the radius of the helix formed by the conductor, $\gamma_0$ is a free space wavelength at a frequency within said given range of frequencies, $J_1$ is a Bessel function of the order of one and $J_2$ is a Bessel function of the order of two, $\gamma$ is the propagation constant along the helical conductor, and $k$ is $2\pi/\lambda_0$.

* * * * *